US006799374B1

(12) United States Patent
Goldstein et al.

(10) Patent No.: US 6,799,374 B1
(45) Date of Patent: Oct. 5, 2004

(54) BELT WEARABLE PENCIL SHARPENER

(76) Inventors: Robert Goldstein, 649 N. Harper Ave., Los Angeles, CA (US) 90048; Leslie Goldstein, 649 N. Harper Ave., Los Angeles, CA (US) 90048

( * ) Notice: Subject to any disclaimer, the term of this patent is extended or adjusted under 35 U.S.C. 154(b) by 0 days.

(21) Appl. No.: 10/348,807

(22) Filed: Jan. 23, 2003

(51) Int. Cl.[7] ..... B43L 23/02
(52) U.S. Cl. ..... 30/454; 30/451; 144/28.1
(58) Field of Search ..... 30/451, 452, 453, 30/454, 457, 458, 459; 144/28.1

(56) References Cited

U.S. PATENT DOCUMENTS

| | | | | | |
|---|---|---|---|---|---|
| 2,169,908 | A | * | 8/1939 | Wells | 30/454 |
| 4,402,354 | A | * | 9/1983 | Halpern | 30/454 |
| 4,741,105 | A | * | 5/1988 | Wong | 30/123 |
| 4,759,441 | A | | 7/1988 | Leurck | 206/373 |
| 5,077,903 | A | | 1/1992 | Kreim | 30/451 |
| 5,388,741 | A | | 2/1995 | Hillinger | 224/253 |
| D405,830 | S | | 2/1999 | Mak | D19/72 |
| 6,065,514 | A | | 5/2000 | New | 144/28.5 |
| 6,233,789 | B1 | | 5/2001 | Douglas | 24/3.12 |
| 6,457,498 | B1 | * | 10/2002 | Salus et al. | 144/28.1 |

* cited by examiner

*Primary Examiner*—Hwei-Siu Payer
(74) *Attorney, Agent, or Firm*—Goldstein Law Offices PC.

(57) ABSTRACT

A portable pencil sharpener, for use upon a belt, in sharpening pencils, having a housing having a top having a top opening, a rear, and defining an internal cavity. A belt clip is located on the rear to facilitate attachment to the belt. A motorized sharpener assembly is located within the housing for automatically sharpening a pencil when inserted through the top opening. A power pack is located within the housing and has batteries for powering the motorized sharpener assembly. A charging plug and charging circuit allow the batteries to be recharged for subsequent use.

4 Claims, 4 Drawing Sheets

BELT WEARABLE PENCIL SHARPENER

BACKGROUND OF THE INVENTION

The invention relates to a belt wearable pencil sharpener. More particularly, the invention relates to an electric portable pencil sharpener which is configured to be worn on the belt of a user.

A variety of occupations, vocations, and hobbies require frequent use of a pencil when performing various tasks. For this reason, many tool belts have pencil holders. For many of these tasks, the pencil is used on a surface which is far from ideal. In particular, lumber, sheetrock, and even stone sometimes require a pencil mark. Further, since the pencil is often used immediately after using power and hand tools which require considerable strength, the user is typically less than gentle when using the pencil. Accordingly, frequently the pencil must be sharpened either because it has become dull, or because the tip has broken altogether.

Several combination tools have been devised which demonstrate the need for pencils in the workplace. In particular, U.S. Pat. No. 5,388,741 to Hillinger discloses a tape measure with a belt clip which has a pencil holder. U.S. Pat. No. 6,233,789 to Douglas discloses a square tool with a tape measure that has a built in manual pencil sharpener. U.S. Pat. No. 4,759,441 to Leurck discloses a combination tool for use in hanging wallpaper which includes a manual pencil sharpener.

U.S. Pat. No. 5,077,903 to Kreim discloses a carpenter's pencil sharpener that is meant for tabletop use and requires a connection to a line power source. Kreim ignores the fact that at many work sites, a line power source is not readily available.

U.S. Pat. No. 6,065,514 to New discloses a compact handheld battery operated pencil sharpener. New does not disclose any convenient way for carrying the sharpener or holding it upon one's person.

While these units may be suitable for the particular purpose employed, or for general use, they would not be as suitable for the purposes of the present invention as disclosed hereafter.

SUMMARY OF THE INVENTION

It is an object of the invention to produce a pencil sharpener which is portable, and may be easily carried by a user upon his/her belt. Accordingly, the pencil sharpener is self-contained within a housing, and has a rear mounted belt clip for allowing attachment to a tool belt or ordinary dress belt.

It is another object of the invention to provide a pencil sharpener which automatically sharpens a pencil with only minimal labor by the user. Accordingly, the pencil sharpener is activated by an insertion switch, and the pencil is sharpened by a motorized sharpening assembly.

It is a still further object of the invention that the pencil sharpener may be used repeatedly and conveniently recharged when necessary. Accordingly, the pencil sharpener has an internal battery pack to allow fully portable use, and has an incorporated battery charger for allowing the battery pack to be recharged by connection to a line source without requiring an additional "recharger" component.

The invention is a portable pencil sharpener, for use upon a belt, in sharpening pencils, having a housing having a top having a top opening, a rear, and defining an internal cavity. A belt clip is located on the rear to facilitate attachment to the belt. A motorized sharpener assembly is located within the housing for automatically sharpening a pencil when inserted through the top opening. A power pack is located within the housing and has batteries for powering the motorized sharpener assembly. A charging plug and charging circuit allow the batteries to be recharged for subsequent use.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
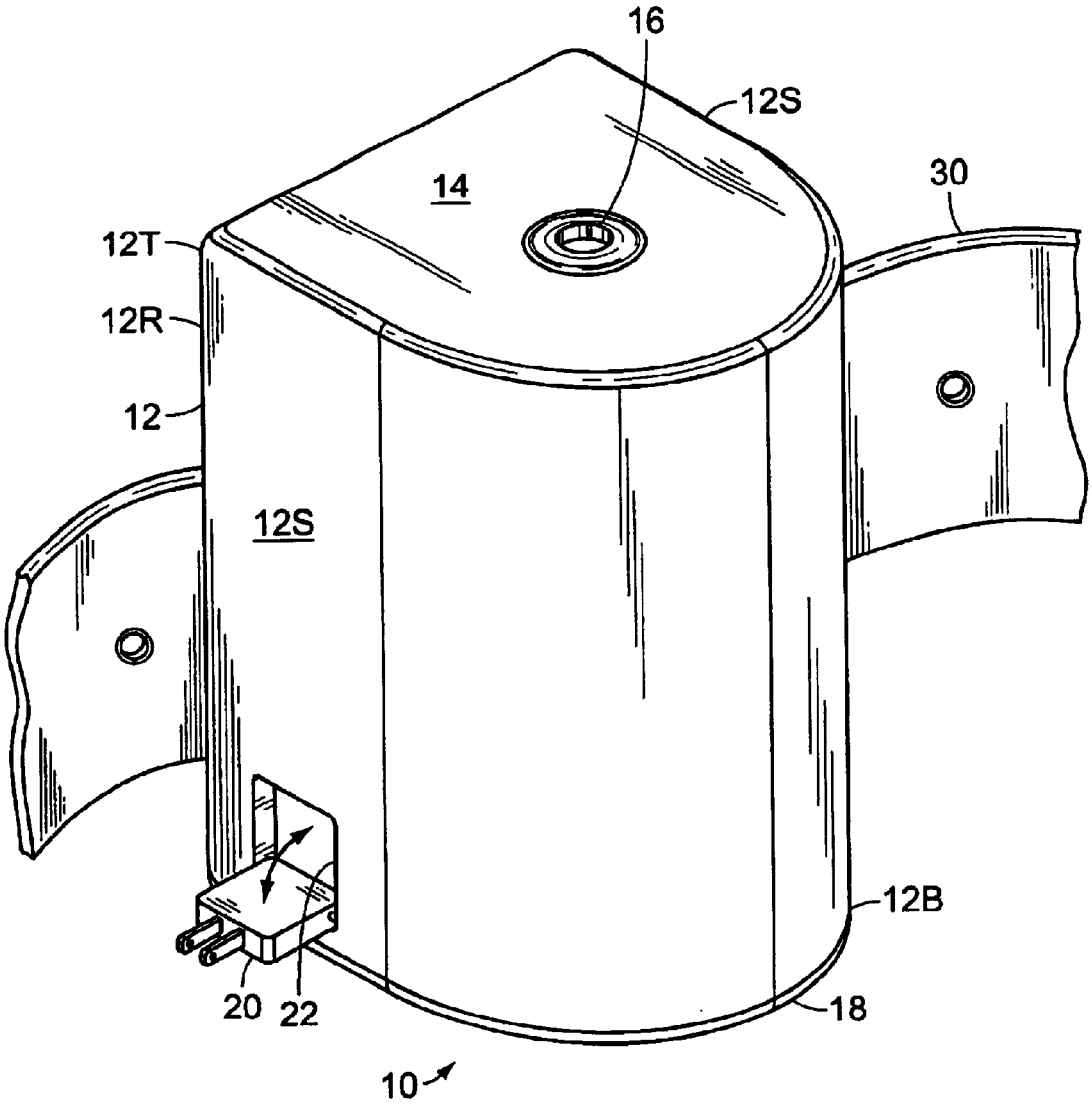
FIG. 1 is a diagrammatic perspective view, illustrating the fully assembled pencil sharpener, attached onto a belt, and illustrating the retracting and extending of the recharging plug.

FIG. 1 illustrates a portable pencil sharpener 10, having a housing 12 which has a top 12T a bottom 12B, sides 12S, a front 12F, and a rear 12R. The front is preferably a smooth curve which bows forward from the sides 12S. The housing 12 has a substantially uniformly shaped cross section between the top 12T and bottom 12B. The top 12T has a top panel 14 having a top opening 16. The bottom 12B has a bottom door 18.

A charging plug 20 is located near the bottom 12B and rear 12R on one of the sides 12S. In particular, the charging plug extends within a charging plug opening 22 in the side 12S, the charging plug is pivotally attached within the charging plug opening 22 so that it may be retracted for storage, and extended for use in recharging the portable pencil sharpener, as will be discussed in further detail below.

Figure 2:
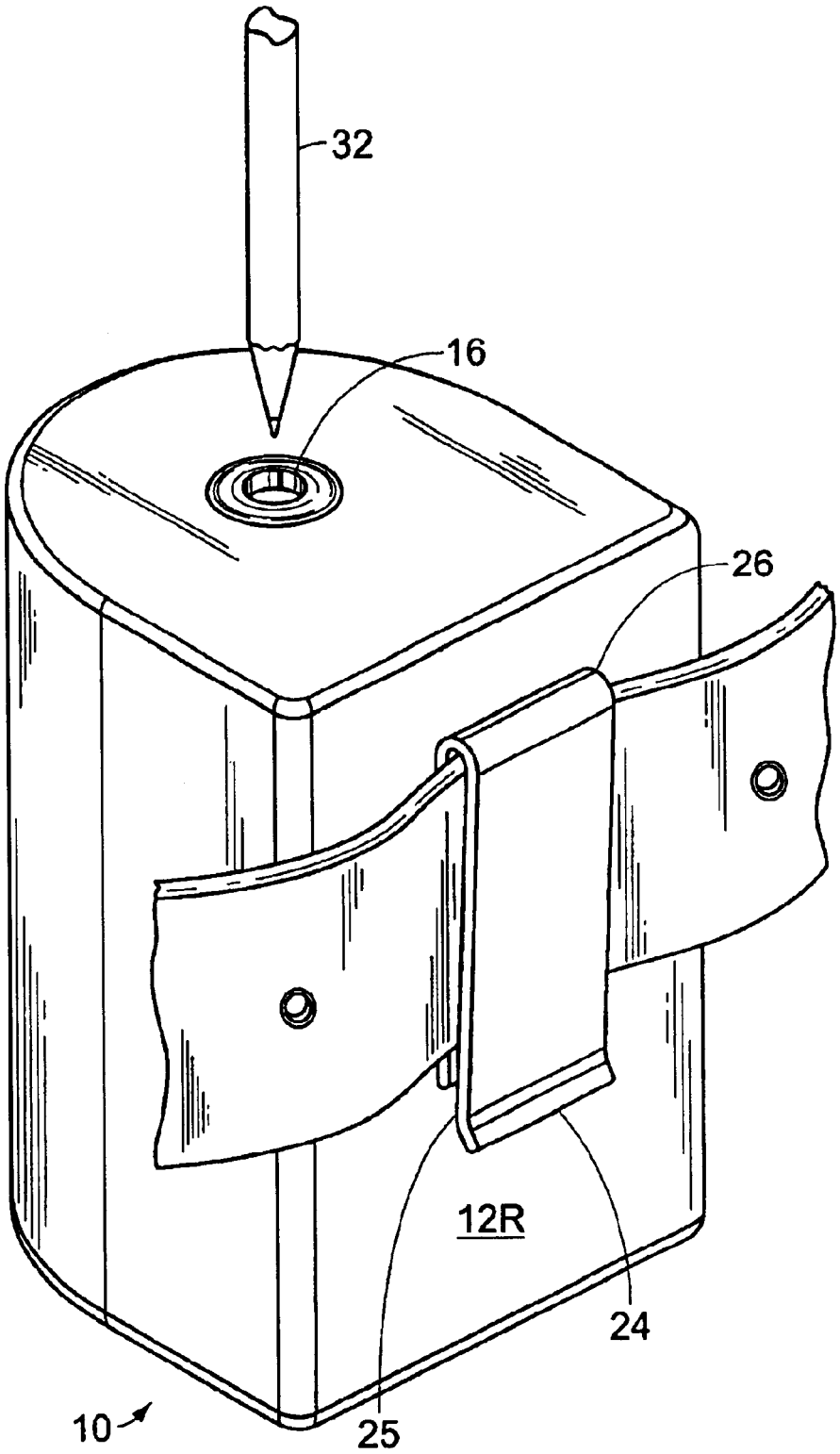
FIG. 2 is a rear perspective view, illustrating the belt clip and attachment thereof onto the belt, and further illustrating the pencil about to be inserted into the top opening.

The portable pencil sharpener 10 is attached to a belt 30. In particular, the belt 30 extends across the rear 12R of the housing 12. Referring to FIG. 2, A belt clip 24 is located on the housing rear 12R. The belt clip 24 has a slot 25 and a clip apex 26, for allowing the belt 30 to extend horizontally across the housing rear 12R with the belt 30 extending through the slot 25 and supporting the weight of the portable pencil sharpener by the belt 30 resting against the clip apex 26. Also seen in FIG. 2, a pencil 32 is about to be inserted through the top opening 16 for sharpening.

Figure 3:
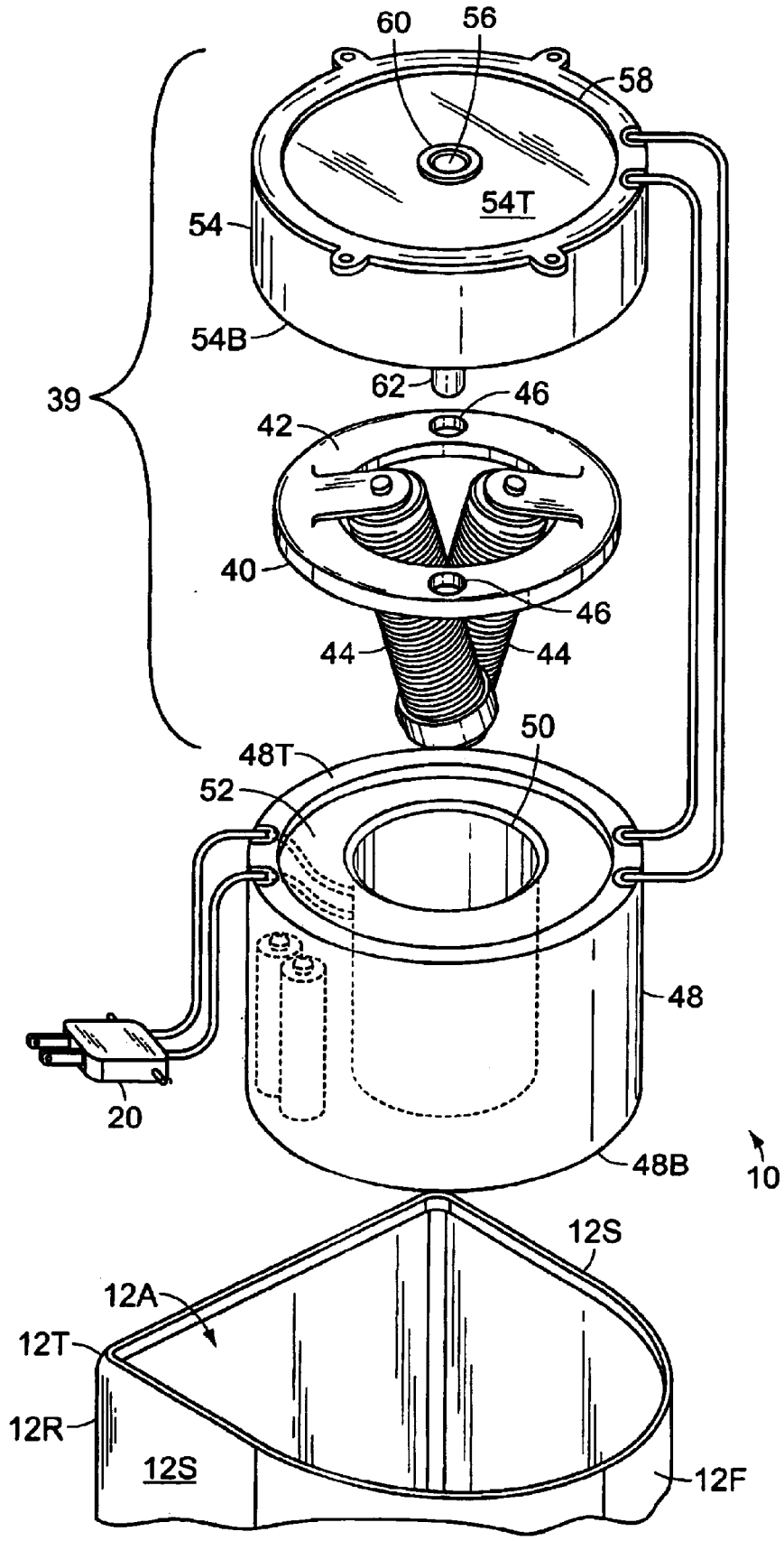
FIG. 3 is an exploded view, illustrating the major internal components of the pencil sharpener.

FIG. 3 diagrammatically illustrates the housing 12, which has an internal cavity 12A which extends substantially between the front 12F, rear 12R, sides 12S, top 12T and bottom 12B, and snugly accommodates and houses internal components of the pencil sharpener 10. In particular, a motorized sharpening assembly 39 includes a sharpening assembly 40 and a motor assembly 54. The sharpening assembly 40 includes a main disk 42 and a pair of angular sharpening blades 44 extending downward from the main disk. The main disk 42 has a central opening for allowing the pencil to extend downward toward the angular sharpening blades 44. In addition, the main disk 42 has a pair of drive holes 46 for rotating the main disk 42. A power pack 48 is substantially cylindrical in shape, having a top 48T and a bottom 48B. A shavings bin 50 extends between the top 48T and bottom 48B and is open at both the top 48T and bottom 48B. The power pack 48 has a disk recess 52 at the top 48T for accommodating the main disk 42 of the sharpening assembly 40 and allowing the sharpening blades 44 to extend downward into the shavings bin 50.

The motor assembly 54 has a top 54T, a bottom 54B and is substantially cylindrical in shape, having substantially the same outside diameter as the power pack 48. The motor assembly 54 has a rotating pencil conduit 56 extending vertically, fully from the motor assembly top 54T to bottom 54B. The motor assembly has a mounting plate 58 which facilitates stabilizing the motor assembly 54 and other components attached thereto, within the housing 12. The motor assembly includes an internal motor, and gearing necessary to rotate the pencil conduit and rotate the sharpening assembly 40. In particular, the motor assembly 54 includes a pair of drive pins 62 (one of which is seen in FIG. 3), which engage the drive holes 46 to rotate the main disk 42 with an orbital motion of the drive pins 62. The disk recess 52 seats the main disk 42 for smooth rotation. An activation switch 60 is located at the motor assembly top 54T, in communication with the pencil conduit 56 for activating the motor assembly 54 in response to the presence of a pencil to be sharpened.

The power pack 48 contains internal rechargeable batteries, as well as a charging circuit. The power pack 48 is connected to the charging plug 20. The charging circuit allows the charging plug 20 to be connected to an AC line source, and provides DC electricity at a reduced voltage for charging the internal rechargeable batteries. In addition, the power pack 48 is connected to the motor assembly 54, for communicating power thereto which is switched on and off by the activation switch 60.

Figure 4:
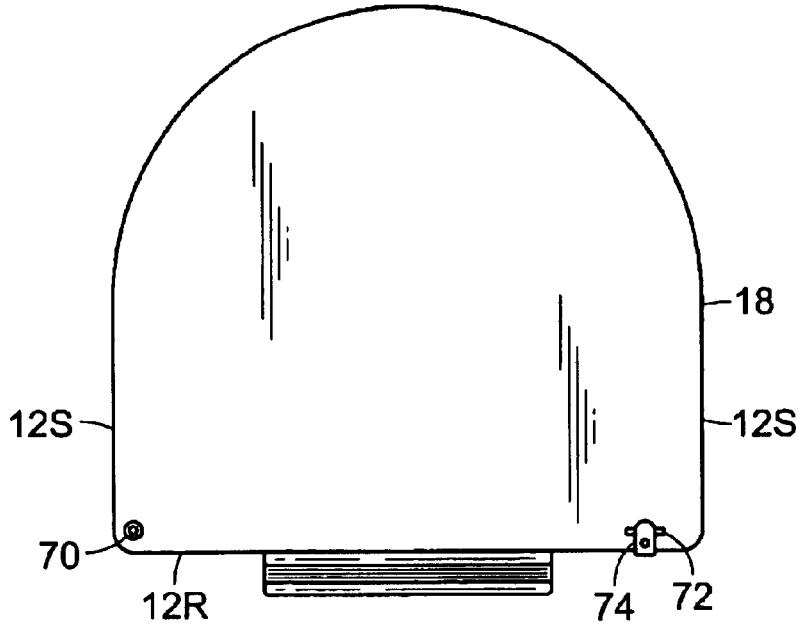
FIG. 4 is a bottom plan view, illustrating the bottom door in the locked position.
Figure 5:
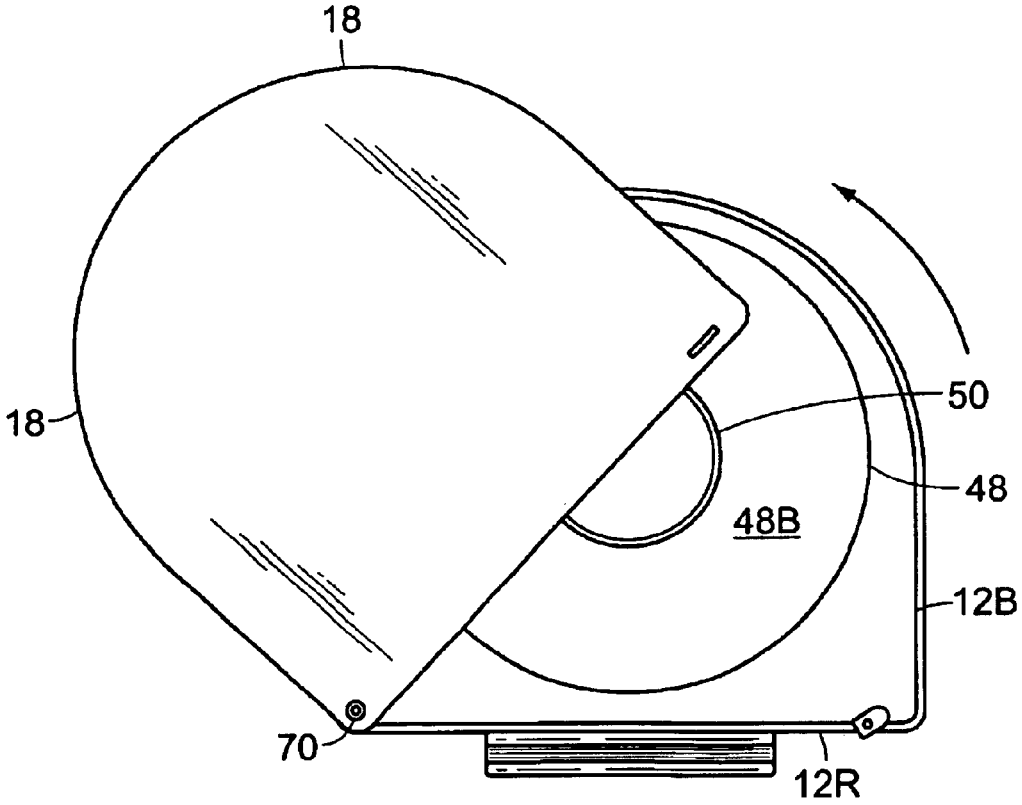
FIG. 5 illustrates the bottom door unlocked and swung partially open, to allow pencil shavings to be dumped from the shavings bin.

Referring now to FIG. 4, the bottom door 18 is in the closed position. The bottom door 18 is attached at a vertical pivot hinge 70 near one of the sides 12S and the rear 12R of the housing 12. A protuberance 72 extends slightly downward from the bottom door 18 at an opposite side from the vertical pivot hinge 70. A sliding latch 74 is attached to the rear wall 12R and selectively engages the protuberance 72, as shown in FIG. 4, to keep the bottom door 18 closed; and selectively disengages the protuberance 72 to allow the bottom door 18 to pivot open about the vertical pivot hinge 70, as shown in FIG. 5. When the bottom door 18 has been pivoted sufficiently open, shavings can be dumped from the shavings bin 50, through the bottom 48B of the power pack 48. Once the shavings have been dumped, the bottom door 18 is pivoted closed and the latch 74 is reengaged with the protuberance 72 to maintain the shavings within the housing 12.

In conclusion, herein is presented a portable pencil sharpener which is conveniently carried upon the belt, allows pencils to be easily sharpened with a motorized sharpening assembly, and which is easily recharged for subsequent use. The invention is illustrated by example in the foregoing description and the appended drawing figures. Numerous variations therefrom are possible while adhering to the inventive concept. Such variations are considered a part of the present invention, limited only by the scope of the claims.

What is claimed is:

1. A portable pencil sharpener, for attaching to a belt, comprising:

a housing, having a rear, a top having a top opening, and a pair of sides;

a belt clip located on the rear of the housing;

a power pack containing batteries;

a motorized pencil sharpener located within the housing, the motorized pencil sharpener located below the top for sharpening a pencil inserted through the top opening using power from the power pack, wherein the power pack contains a charging circuit, and the sharpener further comprises a charging plug connected to the charging circuit, the charging plug allows the batteries to be recharged from a line power source, and wherein the motorized pencil sharpener further comprises a sharpening assembly having a pair of angled cutting blades; wherein the power pack has a top surface, a bottom surface, and a shavings bin extending between the top surface and bottom surface; and wherein the angled cutting blades extend downward into the shavings bin of the power pack.

2. The portable pencil sharpener as recited in claim 1, wherein the motorized pencil sharpener has a motor assembly having a top, a bottom, and a rotating pencil conduit extending between the top and bottom, the motor assembly has a pair of drive pins for engaging the sharpening assembly and rotating the sharpening assembly with an orbital motion of the drive pins.

3. The portable pencil sharpener as recited in claim 2, wherein the housing has a bottom and a front; wherein the housing has a bottom door, the bottom door is pivotally attached at the bottom of the housing for selectively opening and closing at the bottom of the housing; wherein the bottom door is pivoted open to allow the shavings bin to be emptied at the bottom of the power pack.

4. The portable pencil sharpener as recited in claim 3, wherein the motor assembly, and the power pack are substantially cylindrical, the motor assembly stacks atop the sharpening assembly, which stacks atop the power pack, and wherein a forward wall is curved outward to snugly accommodate the motor assembly, the power pack and the sharpening assembly within the housing.

* * * * *